United States Patent [19]

Guerre-Berthelot

[11] 4,290,150

[45] Sep. 22, 1981

[54] PROTECTIVE HELMETS AND FASTENING DEVICES THEREFOR

[75] Inventor: Pierre Guerre-Berthelot, Lesigny, France

[73] Assignee: G P A International, Chevry Cossigny, France

[21] Appl. No.: 955,946

[22] Filed: Oct. 30, 1978

[30] Foreign Application Priority Data

Nov. 8, 1977 [FR] France ..... 77 33639
Jul. 13, 1978 [FR] France ..... 78 21002

[51] Int. Cl.[3] ..... A42B 3/02

[52] U.S. Cl. ..... 2/421; 2/424; 2/6

[58] Field of Search ..... 2/421, 424, 415, 410, 2/10, 6, 411, 412, 414

[56] References Cited

U.S. PATENT DOCUMENTS

| | | | |
|---|---|---|---|
| 600,778 | 3/1898 | Frazier | 2/421 X |
| 2,105,028 | 1/1938 | Dickhoff | 2/421 |
| 2,861,272 | 11/1958 | Stuart et al. | 2/6 |
| 2,881,442 | 4/1959 | Sowle | 2/9 |
| 2,890,457 | 6/1959 | Marietta | 2/9 |
| 2,892,195 | 6/1959 | Monetta | 2/9 |
| 3,216,023 | 11/1965 | Morgan | 2/9 |
| 3,362,403 | 1/1968 | Fleming | 128/142 |
| 3,418,657 | 12/1968 | Lastnik et al. | 2/6 |
| 3,478,365 | 11/1969 | Varga | 2/3 |
| 3,527,461 | 9/1970 | Prater | 2/424 X |
| 3,991,423 | 11/1976 | Jones | 2/415 |
| 4,024,587 | 5/1977 | Barford | 2/424 |

FOREIGN PATENT DOCUMENTS

| | | | |
|---|---|---|---|
| 2720785 | 11/1978 | Fed. Rep. of Germany | 2/421 |

*Primary Examiner*—Peter P. Nerbun
*Attorney, Agent, or Firm*—Frost & Jacobs

[57] ABSTRACT

A protective helmet for a driver of, or passenger in, a vehicle, which helmet comprises a rigid protective shell and a fastening device comprised essentially of a rigid skirt extending around the base of the shell of the helmet with the interposition of padding inside the skirt and adapted to conform to the lower part of the head. The skirt is composed of two rigid half-skirts hinged on the helmet at opposite points of said base, and the base of the shell of the helmet includes two locking means thereon with additional fixing means on at least one half-skirt. The fastening device ensures the holding of the helmet on the head and prevents its being torn off, even in the case of a fall with successive impacts.

50 Claims, 27 Drawing Figures

PROTECTIVE HELMETS AND FASTENING DEVICES THEREFOR

FIELD OF THE INVENTION

The present invention relates to an improved helmet and fastening device therefor, notably protective helmets for drivers and passengers of two-wheeled vehicles such as motorcycles and the like.

DESCRIPTION OF THE PRIOR ART

The traditional fastening means for a protective helmet is a simple chin-strap, generally constituted by a textile band or a leather strap comprising two strands each fixed at one of their ends to each side of the rigid shell of the helmet, substantially at the level of the articulation of the jaw-bones.

The chin-strap is positioned below the chin, the two strands being joined by a buckle or similar element enabling tightening and holding in position. This device has the serious drawback of being subject to the helmet leaving the head in case of a violent impact directed from back to front; in the case of a fall with rebounds, which is very frequently the case, the wearer is no longer protected from the impacts following the first one.

To attempt to avoid such tearing off of the helmet with the conventional fastening devices, it is necessary to position the chin-strap as close as possible to the larynx, and to tighten it to the maximum extent bearable, which is very uncomfortable.

In addition, inspite of this precaution, the chin strap exerts, at its anchoring points on each side of the helmet, a distinctly off-set force with respect to the transverse median plane of the skull of the wearer of the helmet, which gives rise to a torque tending, on an impact or a fall, to tilt the helmet from back to front by rotation around an axis passing substantially through the wearer's ears.

Hence such prior art device does not enable positive and effective fastening of the helmet to the head of the wearer and in any case does not prevent its leaving the head when on a simple impact, or multiple impacts, occurs.

It is an object of the invention, therefore, to provide an improved protective helmet and fastening device therefor which enables the above mentioned drawbacks to be avoided and which ensures the protective role of the helmet for the skull of the wearer to be completely full-filled, regardless of whatever stresses may be encountered on impact, or on several successive impacts, more particularly during a fall.

GENERAL DESCRIPTION OF THE INVENTION

The improved protective helmet and device for fastening it to the head, according to the present invention, is characterized in that it comprises essentially a rigid shell and rigid skirt extending around the base of the helmet shell with the interposition of padding inside the skirt and adapted to conform to the lower portion of the head, said skirt being composed of two half-skirts hinged on the helmet at opposite points of said base, and two locking means and fixing means enabling said half-skirts to cooperate with the base of the shell of the helmet to secure it on the wearer's head.

In the present description, skirt means the combination of two half-skirts having a shape such that, with the padding that is inserted therein, they mate substantially with the lower portion of the head of the wearer of the helmet, said half-skirts extending around the base of the shell of the helmet, as mentioned above.

The material constituting the skirt must be rigid, but its nature may be of any type. The skirt may be formed of the same material or of a different material than that constituting the shell itself. The type of locking means used is not critical. It is possible to use any locking means enabling the half-skirts to be held in position so as to ensure perfect fastening of the helmet to the wearer's head.

The padding of the rigid skirt may be constituted by a first energy-absorbing layer placed in direct contact with said skirt and a second layer formed of sealed cushions filled with a thermo-formable material enabling it to be conformed with the lower portion of the wearer's head.

In the fastening device according to the invention, the articulations of the two half-skirts are diametrically opposite one another, assuming that the base of the helmet is approximately circular whereby they can also be opened diametrically opposite one another.

The relative position of the articulations with respect to the locking means is not critical. It is however convenient for the locking means to be arranged in the median plane of the axis formed by the articulations of the half-skirts.

The articulations of each half-skirt may be arranged at any place on the base of the shell. It is particularly interesting, advantageous and practical for convenient handling of the helmet, for the half-skirts to be arranged one to the front base of the shell, the other to the rear base of the shell by a hinge or the like. According to one embodiment, the two half-skirts are hinged one to the left lateral base of the shell, the other to right lateral base of the shell by a hinge or the like.

Taking into account the different conformations of the head of helmet wearers, it is possible to provide for the position of the articulations of the two half-skirts on the helmet to be adjustable in height by displacement of the hinges or the like. However, it is observed that the padding inserted between the skirts and the lower portion of the head possesses sufficient elasticity to compensate for the various shapes of the head. It is hence generally possible to dispense with providing a special adjustment means for the articulations of the skirts on the helmet. When the two half-skirts are in closed position, that is to say brought into contact with the shell of the helmet, taking into account the possibility, if necessary, of arranging a protective visor on the helmet, it is particularly indicated that one or more half-skirts arranged below the front of the shell of the helmet should include a ventilation duct taking in external air through openings ensuring the aeration of the inside of the helmet. This ventilating duct also enables misting of the visor to be prevented and thus good visibility to be preserved.

In a particularly preferred embodiment, the ventilating duct on the one or more front half-skirts is replaced by a ventilating system arranged on the front lower portion of the protective helmet. In this case, this ventilating system comprises at least one horizontal port and one vertical slot arranged on the shell of the helmet, and two shoulders arranged on each side of the horizontal port within the shell of the helmet so as to permit the guiding of a shutter provided with at least one row of openings, said shutter sliding along the vertical slot.

In its preferred embodiment, the fastening device according to the invention includes two ventilating systems disposed symmetrically with respect to the longitudinal plane of symmetry of the helmet, each system comprising two horizontal ports and a shutter with two rows of openings.

The protective helmet and fastening device according to the invention can be constructed in two different forms. According to a first embodiment of the invention, the two locking means are borne by the base of the shell of the helmet and the fixing means are borne by at least one half-skirt. According to a second embodiment of the invention, the locking means are borne by one half-skirt and the fixing means are arranged inside the shell, said half-skirt bearing the locking means comprising a heel engaged beneath another heel formed in that second half-skirt which does not include a locking mean.

We will now successively describe these two possible embodiments.

In the first embodiment, the fixing means cooperating with the locking means may be borne by a single half-skirt or by two half-skirts. The fixing means may be of any type having a suitable shape to be able to be engaged in the locking means placed on the helmet.

When the fixing means are borne by the two half-skirts, they can be arranged respectively at the end of each half-skirt. In this case, said fixing means are, for example, articulated tongues in the form of a circular arc with a stop limiting the amplitude of their pivoting, notched on their concave area and directed upwardly.

The tongues are housed within the shell of the helmet and engaged in the locking means placed on the helmet.

It is possible to use any type of locking means enabling the two half-skirts to be held closed and locked, so as to permit complete fastening of the helmet without the risk of its being torn off and being tilted either forwards or backwards. The locking means used are, for example, of the self-wedging type and each includes at the center a sliding drop latch with two diameters, held in place by a spring and accessible from the outside of the helmet by a push button as well two eccentric cams, notched on their periphery, pivoting on fixing bolts of the clasp and abutting in rotation in one direction, by the action of a prestressed helical spring, the notches of the cams cooperating with those of the tongues so as to lock the two half-skirts. When the two half-skirts are locked, each of the tongues becomes wedged between a notched eccentric cam urged onto the notches of the tongue and a sliding drop-latch which can be eclipsed by the action of a finger on a push-button visible on the shell to the place of the locking mean; the spring holds the drop latch in locked position. The locking means also enable adjustment in height of the closing of the half-skirts. This fastening device according to the invention can hence be adapted to the shape of the head.

When the fixing means are borne by a single half-skirt, they are arranged at the ends of said half-skirt. In this case, the half-skirt carrying said fixing means comprises a heel which becomes engaged beneath another heel formed in the half-skirt not including fixing means. As previously, the fixing means are of any type provided that they have a suitable shape to be engaged in the locking means. These fixing means are for example tongues whose construction and form of cooperation with the locking means are identical with those described above. In this case, however, the locking means may be locking means of the self-wedging type each including a sliding drop-latch at the center, with two diameters, held in position by a spring and accessible from the outside of the helmet by a push-button as well as an eccentric cam, notched on its periphery, pivoting on the fixing bolts of the locking mean and abutting in rotation in one direction, by the action of a pre-stressed helical spring, the notches of each cam cooperating with those of each tongue so as to lock the half-skirts.

In one embodiment the fixing means are tongues each having a recess as described in French Pat. No. 75 16 001 published under No. 2,271,781. Each of said tongues then cooperates with the locking mean described in this fore-mentioned patent. Each of these locking means includes a locking pin urged by a spring, said pin, in transverse action perpendicular to the direction of insertion of the tongue, having approximately the shape of an I having two wings and a core, the inner limiting surfaces of the wings being beveled, said tongue cooperating, on its insertion in the locking mean, with said beveled wings against the elastic force of the spring and being blocked in locking position when it is fully engaged in the opening of the locking mean.

When locking means such as described in French Pat. No. 75 16 001 are used for holding and locking the two half-skirts, the adjustment in height of the closing of said half-skirts is obtained by padding material inserted on the half-skirts. Thus, as has been previously indicated, the height adjustment of the closure of the half-skirts is not indispensable for the device according to the invention.

In the second embodiment, the locking means are borne by one half-skirt and the fixing means are arranged inside the shell. In this case, so as to render the shell of the helmet practically undeformable, the two half-skirts include, over practically the whole length of their line joining the shell of the helmet, a shoulder which is engaged beneath the shell on closing and locking.

The presence of this shoulder on the half-skirts leads to three essential advantages:

(a) it eliminates in practice the rupture of the shell and the effect of extreme deformation causing the elastic limit of the material constituting the helmet to be exceeded, (b) it enables the integrality of the shape of the internal space of the helmet to be maintained under the effect of external stress and, for this reason, fully ensures the protection of the wearer's head, and (c) it makes possible the lightening of the shell taking into account high reinforcement of rigidity contributed by the presence of the two half-skirts.

The presence of a shoulder over practically the whole length of the half-skirts enables the slipping of the assembly of said skirts with respect to the shell of the helmet to be avoided.

To further improve the fastening device according to the invention, provision is made to render fast, when they are closed, the two half-skirts in line with the heels which become engaged beneath one another, so as to prevent the half-skirt not carrying locking means to be closed on itself.

In fact, under the effect of a pull tending to tear off the helmet upwards, the lower part of the head brings its weight onto the half-skirts; the half-skirt not bearing locking means therefore tends to be closed on itself in the direction of the small diameter of the helmet or by bending, to slip on the half-skirt bearing the locking means and to draw the latter in its deformation.

There is therefore provided according to the invention, on each side and within the half-skirt bearing the locking means, a boss placed in the zone wherein the heel of the half-skirt not including a locking mean becomes supported, said second half-skirt including a recess correspondingly on each side; the half-skirt bearing the locking means includes in addition in the zone of each locking means an outer tongue housed in the recess formed on the outer edge of the shell of the helmet.

Due to this system of engagement of the fastening device according to the invention, the half-skirt not bearing a locking mean does not risk sliding on the half-skirt bearing the locking means and the latter does not risk being closed on itself. The group of three parts, skirt not bearing a locking mean, skirt bearing locking means, and shell form a rigid assembly not deformable by relative movement of the parts with respect to one another.

In accordance with the second embodiment of the fastening device according to the invention, the two fixing means are arranged within the shell and they have the shape of tongues each having a round recess. These tongues cooperate with two locking means arranged on a single half-skirt so as to hold the helmet in fully fastened positioned without the risk of being torn off and of tilting neither forwards, nor rearwards, nor to the side. This complete stability on the head of the wearer guarantees on the one hand, a constant field of vision in dimension and in position and, on the other hand, obtains greater comfort.

These locking means borne on the half-skirt are self-wedging and each includes a locking latch movable in rotation and urged by a spring, said latch in cross-section being perpendicular to the direction of introduction of the tongue, and having approximately the shape of an I having two beveled insertion ramps and a core said tongue cooperating, on its insertion in the locking means, with said beveled ramps against the elastic force of a spring, and being blocked in locking position when it is fully engaged in the opening of the locking means.

Besides all the advantages mentioned above, the double locking device according to the invention also enables tearing off to be avoided even when one of the two locking means is disengaged. Tests have shown that, in such a hypothesis, the helmet can still withstand up to a 100 kg.f of force without being torn from the wearer's head.

BRIEF DESCRIPTION OF THE DRAWINGS

Some embodiments of the invention are described below by way of non-limiting illustration with reference to the accompanying drawings in which.

DESCRIPTION OF PREFERRED EMBODIMENTS

Figure 1:
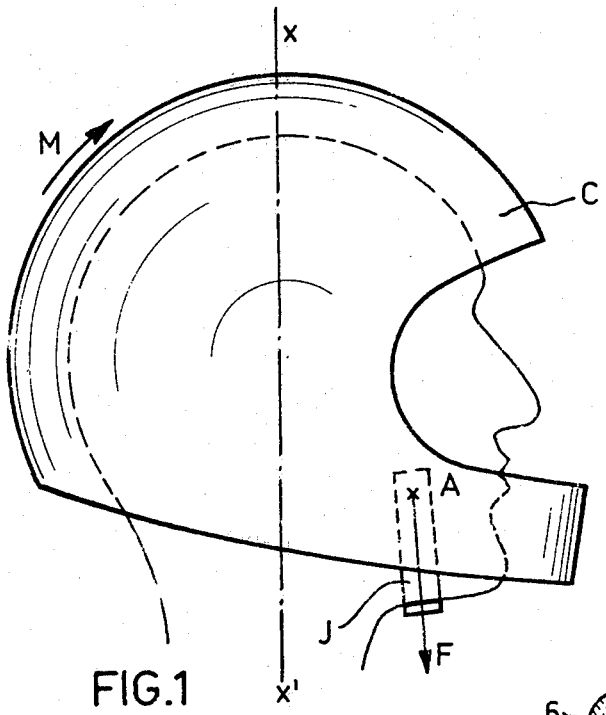
FIG. 1 is a view in lateral elevation of a helmet and fastening device of known type.

FIG. 1 shows, on the head of its wearer, a helmet (C) with a conventional chin strap (J). With such a device, the chin strap (J) exerts at its anchoring points (A), a force (F) distinctly offset with respect to plane xx'. This force (F) bgives rise to a torque tending, on an impact, to cause the helmet to tilt in the direction of the arrow (M), which can result in the tearing off of the helmet.

Figure 2:
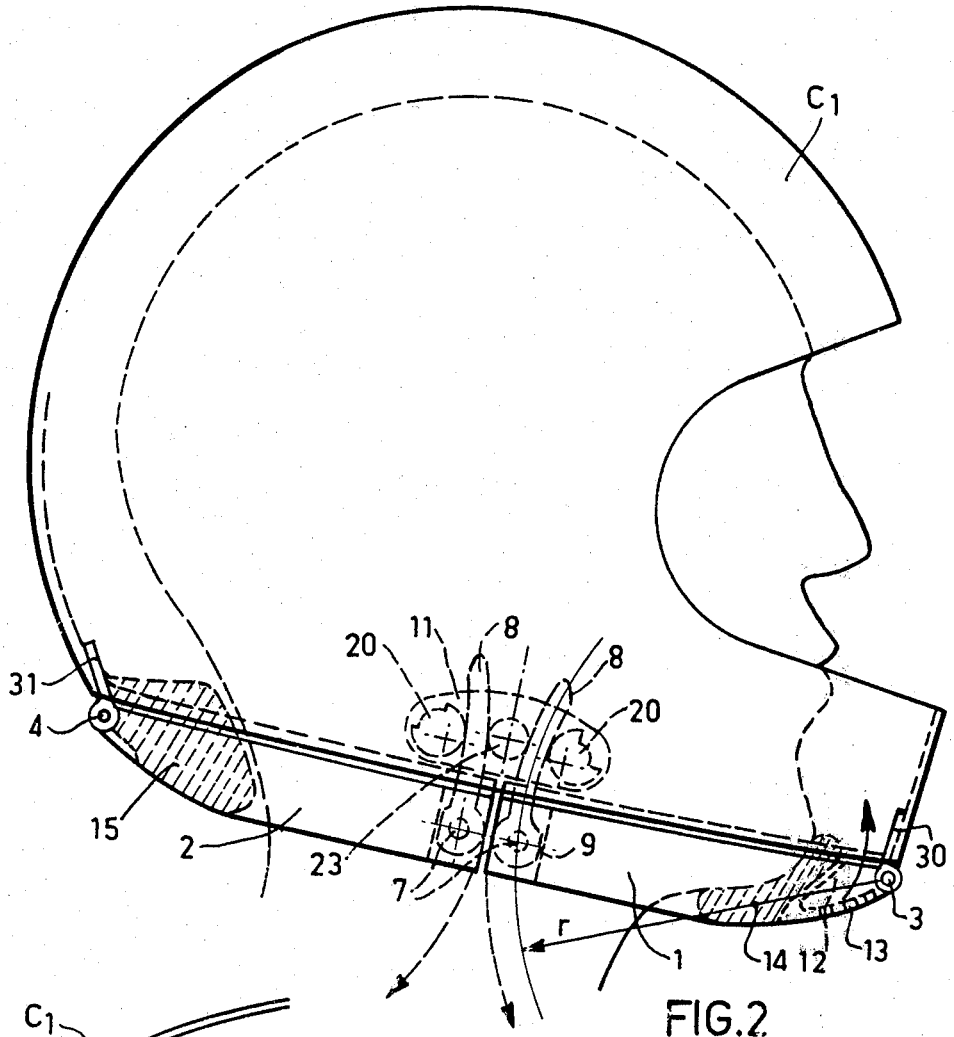
FIG. 2 is a view in lateral elevation of one embodiment of an improved helmet and fastening device, according to the present invention, in which the half-skirts are articulated at the front and at the rear of the base of the shell of the helmet.
Figure 3:
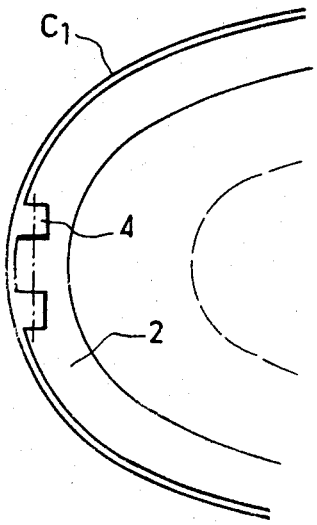
FIG. 3 is a partial underneath view of the rear of the device of FIG. 2.

As shown in FIGS. 2 and 3, the helmet and fastening device according to one embodiment of the invention comprises two half-skirts (1) and (2) arranged at the base of the shell of the helmet $C_1$. The half-skirt (1) is articulated at the front of the base of the shell of the helmet by means of the hinge (3), and the half-skirt (2) is articulated at the rear of the base of the shell of the helmet by means of the hinge (4). The hinges (3) and (4) cooperate with their respective counterparts (30) and (31), fixed under the shell of the helmet $C_1$, to permit pivoting of the two half-skirts (1) and (2). These two half-skirts are obtained by by molding or injection with the same material as the shell or of any other rigid material. At each of their ends, the half-skirts (1) and (2) comprise on the inside, pivots (7) with a horizontal axis on which the tongues (8) are articulated. These tongues are notched and curved in a circular arc of radius r having its center on the axis of the hinge, their hinging movement being limited by a flat (9) becoming supported on another flat molded in the half-skirt. The locking means (11) arranged beneath the shell of the helmet comprises a draw latch (23) and two eccentric cams (20). The locking mean is described below with reference to FIGS. 5 to 9.

The front half-skirt includes at its front portion a cavity (12) opening at the lower part of the face, openings (13) formed in this cavity enabling internal aeration of the helmet.

The two half-skirts are internally lined with a padding (14) which becomes seated under the chin and the lower jaw and a padding (15) which becomes seated on the nape of the neck. These paddings are firmly fixed to the half-skirts and, in addition, become imprisoned by the concave shape of the latter.

The helmet $C_1$ being placed on the wearer's head, the two half-skirts (1) and (2) are closed by causing them to pivot on their respective hinges (3) and (4); the notched tongues (8) are engaged in the locking means (12) and the helmet thus becomes fully fastened.

Figure 4:
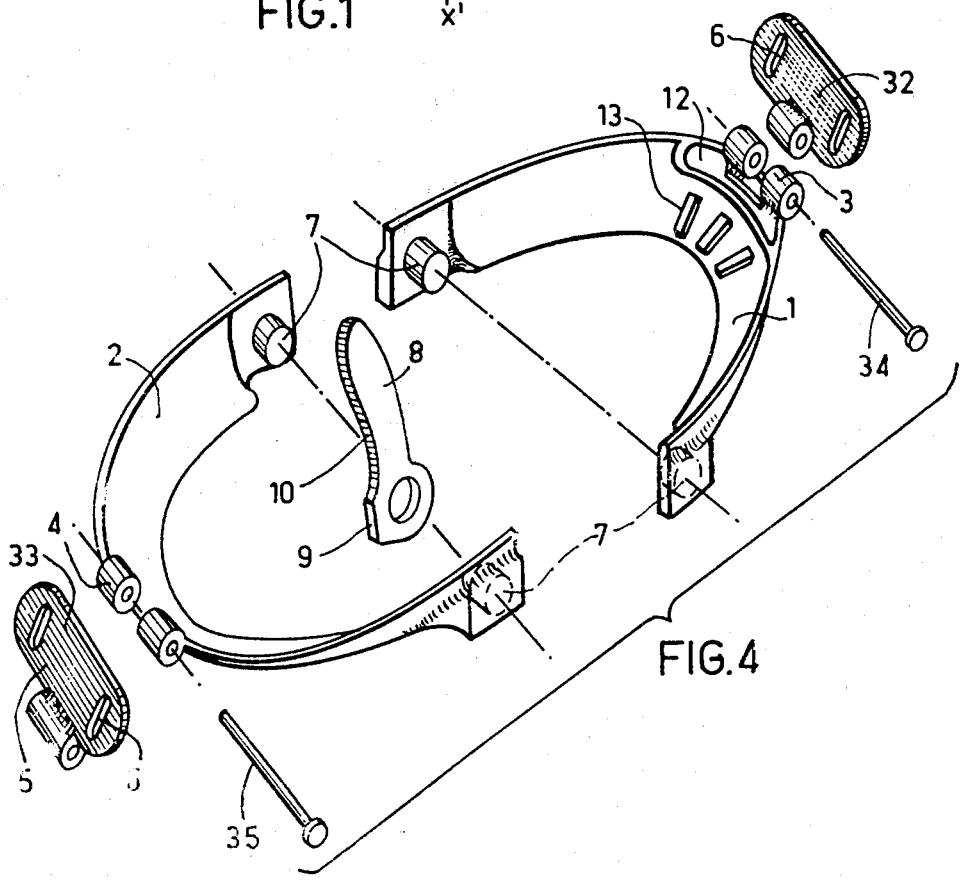
FIG. 4 is an exploded perspective view of the various elements of the device of the invention illustrated in FIGS. 2 and 3.

FIG. 4 shows in exploded perspective, the various elements of the fastening device according to the invention, as shown in FIGS. 2 and 3. Identical elements are given the same references. The front half-skirt (1) comprises a hinge (3), a cavity (12) opening at the lower part of the face, openings 13 of any shape, and pivot 7 with a horizontal axis on which the tongues 8 become positioned. The tongues 8 (of which one only is shown) include a flat 9 and notches 10 on their concave area. The hinge 3 cooperates with its counterpart 32 fixed by means of bolts (not shown) on the shell. The hinge 3 is fast to the part 32 by means of a rod 34 forming an axis for the pivoting of the half-skirt 1. The half-skirt 2 comprises a hinge 4 and pivot 7 with a horizontal axis on which the tongues 8, identical with those of skirt 1, become positioned. The hinge 4 operates with its counterpart 33 fixed by means of bolts (not shown) on the shell. The hinge 3 is fast to the part 33 by means of a rod 35 forming an axis for the pivoting of half-skirt 2.

The fixing plates of the counterplates 32 and 33 as well as the applicaton area within the shell are provided with nicks 5 and oval fixing ports 6 so as to enable adjustment of the pivoting axle in the direction of the height.

Figure 5:
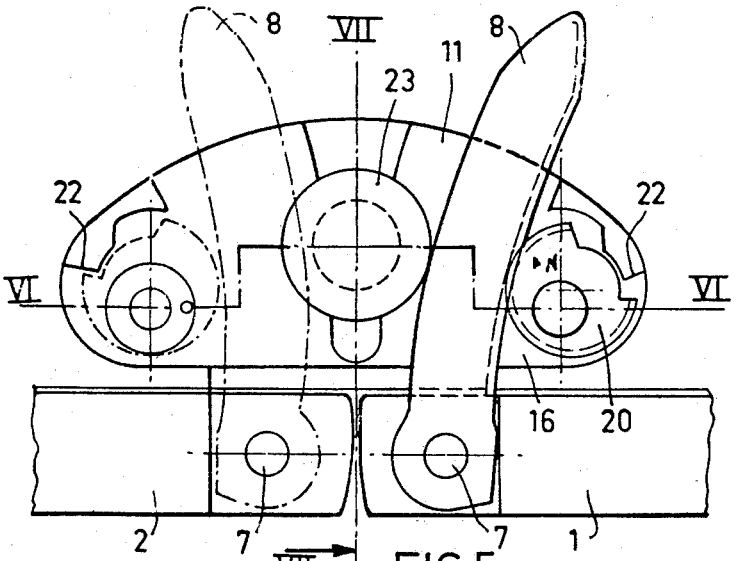
FIG. 5 is a view in elevation of one of the two locking means used in the device of FIG. 2, the right portion of the figure showing the tongue of the locked half-skirt, the left portion showing the unlocked tongue.
Figure 7:
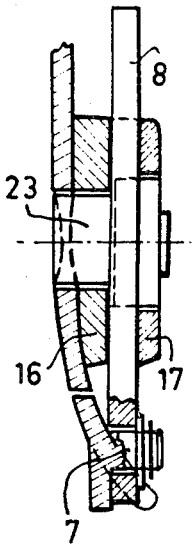
FIG. 7 is a sectional view of the locking means along the line VII—VII of FIG. 5.
Figure 6:
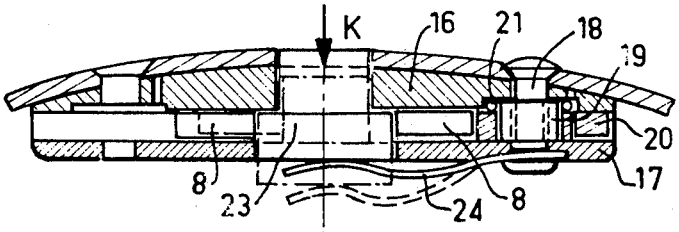
FIG. 6 is a sectional view of the locking means along the line VI—VI of FIG. 5.
Figure 9:
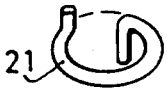
FIG. 9 shows the spring of the locking means.
Figure 8:
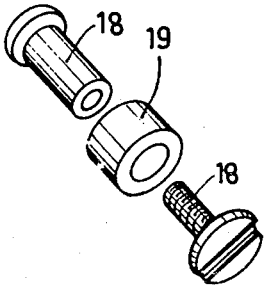
FIG. 8 is a perspective view of a locking means fixing means.

The locking means 11, shown in detail in FIGS. 5,6 and 7, is composed of a body 16 and cover 17 assembled together and to the shell of the helmet by two special bolts 18 shown in perspective within FIG. 8. On each bolt 18 is placed a ring 19 (FIG. 8) forming a spacer and clamped between the body 16 and the cover 17; each spacer 19 serves as a pivot for a cam 20 notched on its periphery with the same profile as the tongues 8. Each cam 20 is urged in rotation in direction of arrow N by a spring 21 shown in FIG. 9 and housed in a circular recess of the body 16 concentric with the spacer 19. Each cam includes a stop 22 limiting the amplitude of its rotation in the direction N given by the spring.

At the center of the body 16 and of the cover 17 is formed a cylindrical bore with two diameters, the largest being in the cover 17. Facing the bore of the body 16 is a corresponding bore traversing the shell of the helmet. A drop latch 23 with two corresponding diameters and held by a spring 24, slides into the bore, the large diameter coming into abuttment on the entrance of the small bore of the body 16.

When the two half-skirts are closed (right hand portion of FIG. 5), the tongue is inserted in the locking means; its smooth convex area is supported on the large diameter of the drop-latch 23 and its notched concave area pulls the cam 20 in rotation in the direction opposite to N and thus enables the full insertion of the tongue into the locking means. On the other hand, due to the effect of the spring 21 and to that of the wedging of the cam 20, any downward movement of the tongue becomes impossible.

When the finger is pressed on the drop latch 23 along K (left hand portion of FIG. 5), the tongue loses its support on the large diameter of the drop latch 23 and thus becomes released by the passage, between the cam 20 brought back into position of abutment on 22 by the effect of the spring 21, and the small diameter of the drop latch is greater than the width of the tongue. When the tongue 8 is fully emerged from the locking means and the action of the finger on the drop latch 23 ceases, the latter, on the action of the spring 24, resumes its position.

To fasten the helmet, it suffices, after having placed it on the head, to raise the two half-skirts 1 and 2 again by causing them to pivot around their respective hinges, the tongues 8 being engaged in the locking means 11, and the desired adjustment is done notch by notch by raising the two half-skirts more or less, simultaneously or separatly; no downward movement is possible.

To take off the helmet, it suffices to grip the helmet, with one hand on each side, the index finger of each hand pressing simultaneously along K (FIG. 6) on the part of the drop latch 23 forming a push button, the tongues 8 becoming released; by lifting the helmet, it is then easily removed. It is understood that the thus fastened helmet cannot be torn off in any way by an accidental fall, if this is not that of an unlocking operation by acting on the two push buttons.

If, on accidental impact on one of the sides, one of the buttons is pressed in, the other locking means holds the helmet sufficiently to prevent it from leaving the head of the wearer, whence a practically complete safety is derived.

In addition to the safety, this fastening means prevents any movement of the helmet with respect to the head and through this fact ensures undeniable comfort, if only by the non-varying positioning of the front opening which avoids any partial obstruction of the field of vision.

Figure 10:
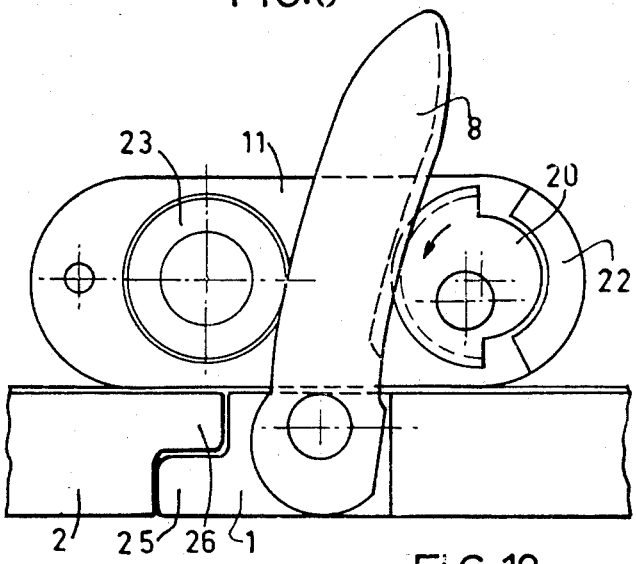
FIG. 10 shows a view in lateral elevation of a second type of locking means used in the fastening device according to the invention.

In the case of the modification of the locking means 11 shown in FIG. 10, there is provided a hooking of the two half-skirts 1 and 2 in line with their fixing in closed position. This hooking is achieved by means of a heel 25 occupying the lower half height of the half-skirt 1 and becoming nested below a heel 26 occupying the upper half-height of the half-skirt 2.

Only the half-skirt 1 includes a tongue 8 becoming engaged in a locking means of the same principle as the previously-described one, but simplified and including a drop-latch 23 and single cam 20 urged in rotation, said cam 20 including also a stop 22 limiting the amplitude of its rotation. To fasten the helmet, it suffices to first raise the half-skirt 2 again and then the half-skirt 1. When the tongue 8 becomes locked, the half-skirt 2 becomes imprisoned in the half-skirt 1.

This simplified device enables a gain in cost and weight, but does not permit individual adjustment of each of the half-skirts for adaptment to the head. In this case the adjustment in height of the half-skirt is obtained by the compensating padding.

Figure 11:
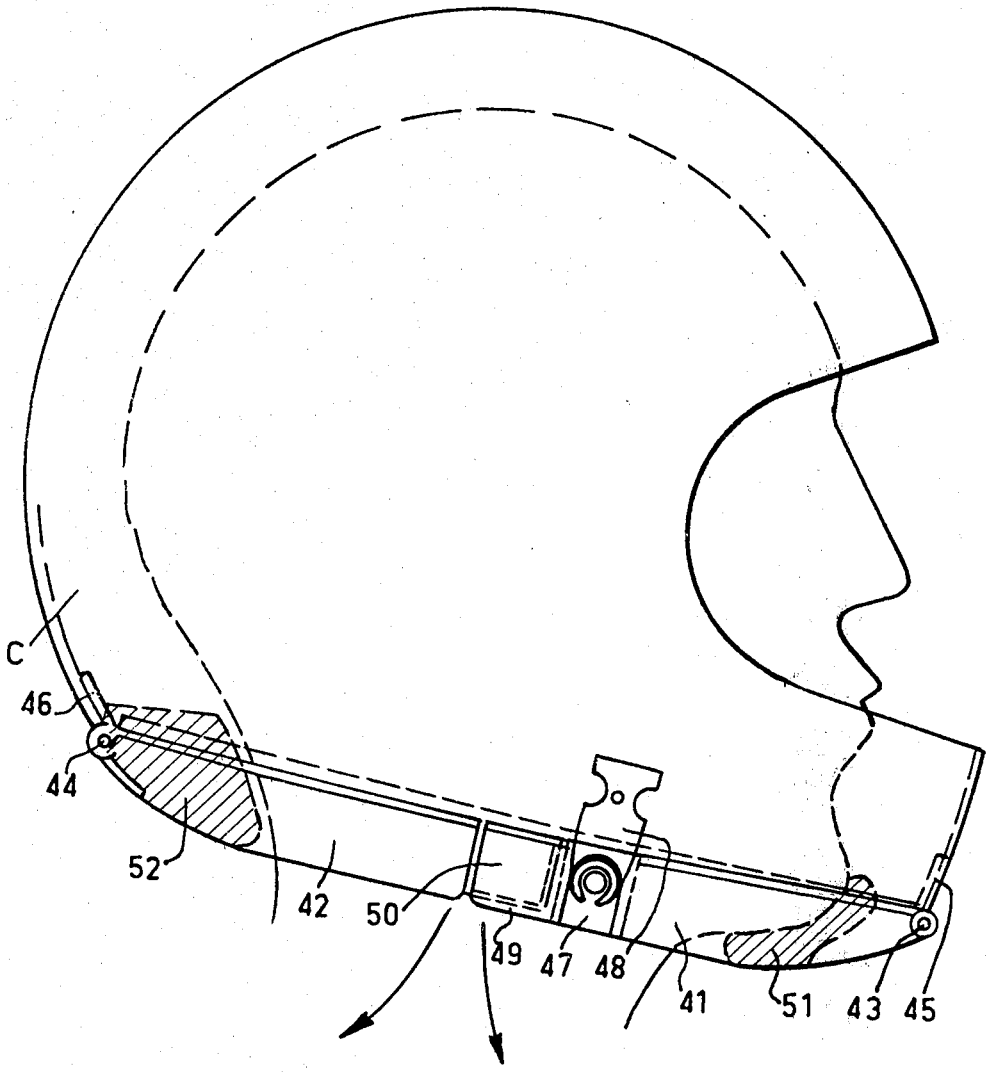
FIG. 11 is a view in side elevation of another embodiment of the improved helmet and fastening device, according to the present invention, in which the half-skirts are articulated at the front and the rear of the base of the shell of the helmet.
Figure 12:
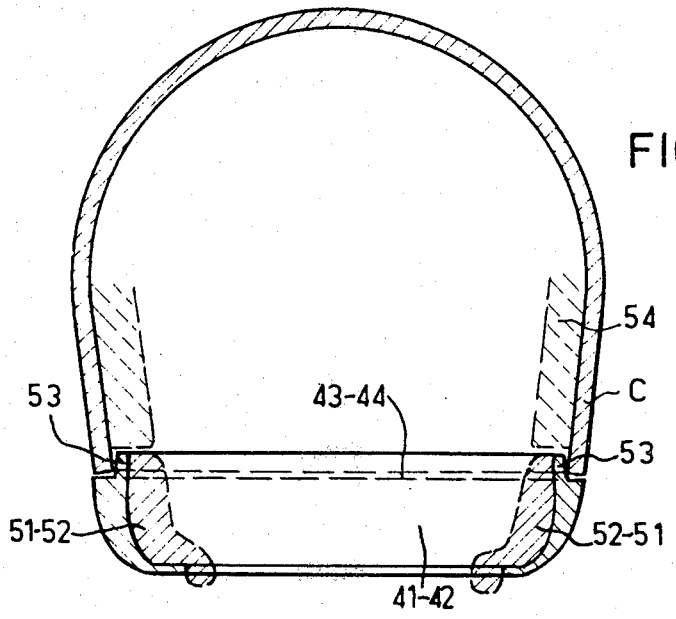
FIG. 12 is a vertical cross-section of the device of FIG. 11.

As shown in FIGS. 11 and 12, the helmet and fastening device according to another and preferred embodiment of the invention comprises two half-skirts 41 and 42 arranged at the base of the shell of the helmet C. The half-skirt 41 is articulated at the front of the base of the shell of the helmet by means of the hinge 43 and the half-skirt 42 is articulated at the rear of the base of the shell of the helmet by means of the hinge 44. The hinges 43 and 44 cooperate with their respective counterparts 45 and 46 fixed below the shell of the helmet C to enable pivoting of the half-skirts 41 and 42, around a rod 46 forming an axis for said half-skirts. A locking device 47 is provided on the half-skirt 41, cooperating with the fixing means 48 fixed inside the shell of the helmet C. The locking device 47 and the fixing means 48 are described in more detail with reference to FIGS. 14 to 23. The half-skirt 41 includes a heel 49 becoming nested below another heel 50 formed in the half-skirt 42; half-skirt 42 does not include a locking means. This half-skirt 42 is held in locked position by means of the presence of the heels 49 and 50. The paddings provided respectively on the front half-skirt 41 and on the rear half-skirt 42, are denoted by 51 and 52.

As already mentioned above, the paddings 51 and 52 are composed of two layers. The first energy absorbing layer placed in contact itself with the skirts is designed for protection in the case of impact on the skirts themselves. This first layer is of a material identical with or similar to that of the inner layer 54 of the shell C. The second layer, called comfort layer, is formed of sealed cushions filled with a thermoformable material which has the property of becoming shaped to the circumvolutions which are urged upon it and of preserving the acquired shapes. The use of this material enables a sort of flexible molding of the lower portion of the head to be obtained, adapted to each wearer and holds the helmet perfectly in position without causing excessive gripping in the direction of the height on the closing of the skirts.

Thus as is clearly shown in FIG. 12, the two half-skirts 41 and 42, include, over practically the whole length of their line of junction with the base of the shell C, a centering shoulder 53 which is engaged beneath the shell on closing and locking of said half-skirts.

The presence of this shoulder prevents practically any ovalisation of the shell under the effect of lateral, frontal or rear stress at the same time as keeping the skirt assembly from slipping with respect to the shell under the effect of a stress which would be produced on the skirts themselves.

Figure 13:
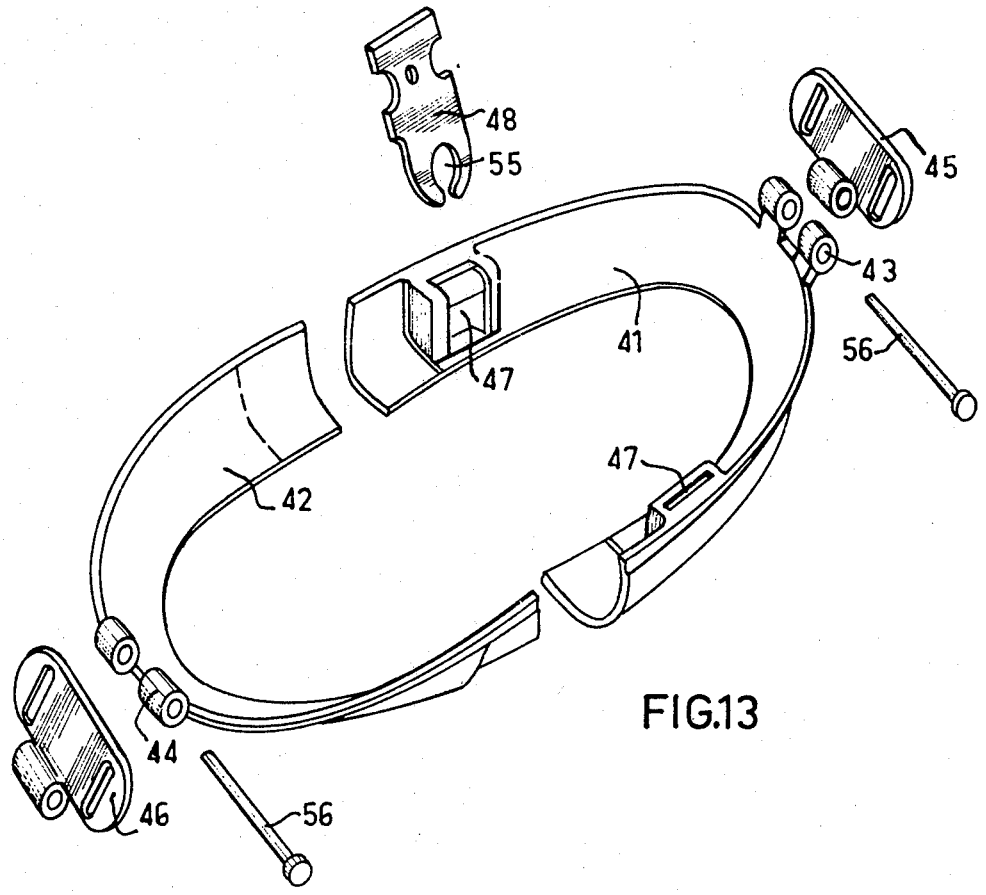
FIG. 13 is an exploded perspective view of the various elements of the device of the invention illustrated in FIG. 11.

FIG. 13 shows in exploded perspective the various elements of the fastening device according to the invention as shown in FIG. 11. Identical elements are given the same references as in FIG. 11. The front half-skirt 41 includes the hinge 43 and, on each of its sides, a locking means 47. This locking means cooperates with a fixing means 48 including a round recess 55 so as to obtain perfect fastening of the helmet on the wearer's head. The half-skirt 42 does not include either a locking means or fixing means and it pivots around its hinge 44.

Figure 14:
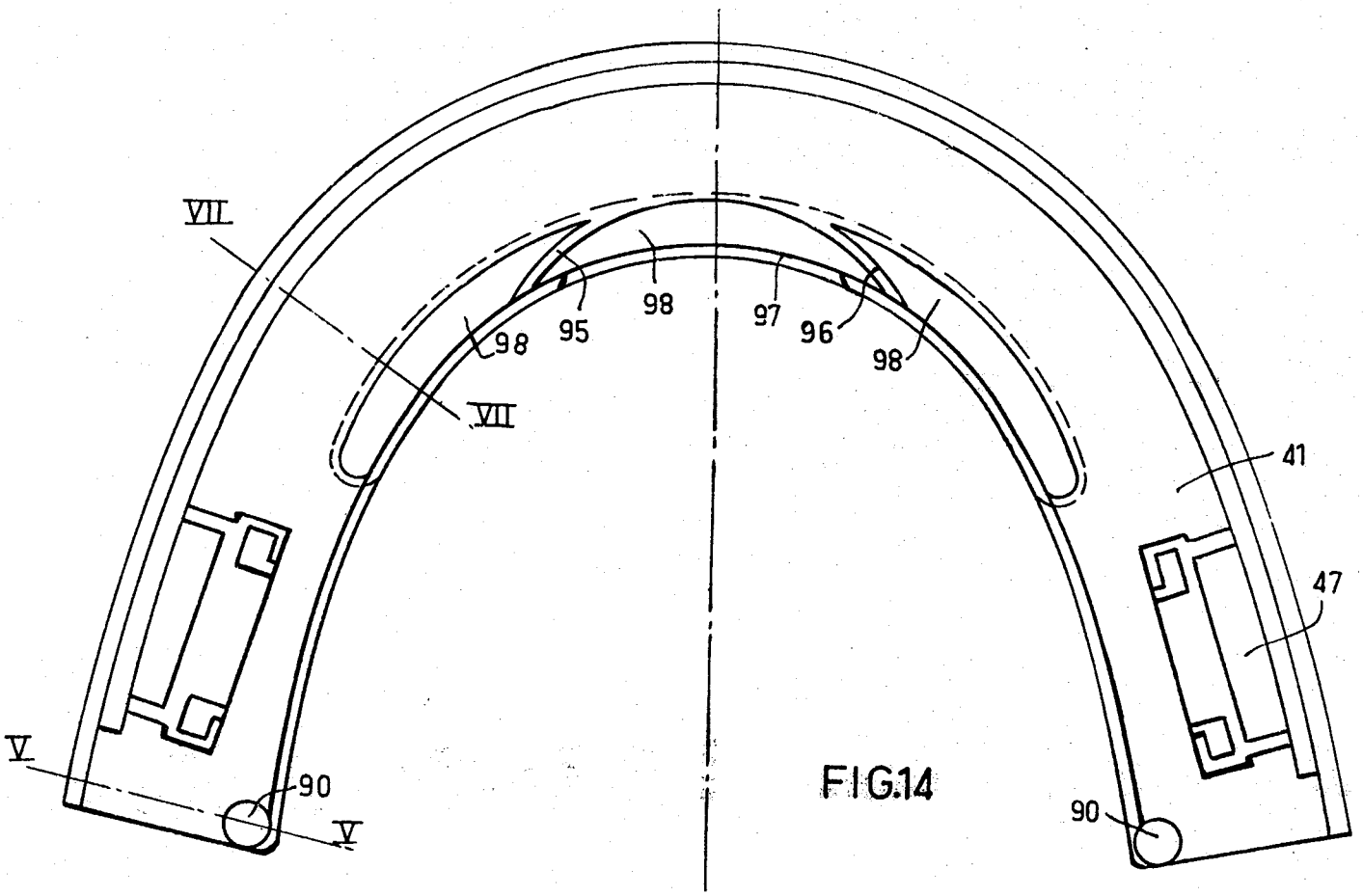
FIG. 14 is a view from above of the front half-skirt of the fastening device according to the invention with a hooking system to make fast the half-skirts and the shock-absorbing system.
Figure 15:
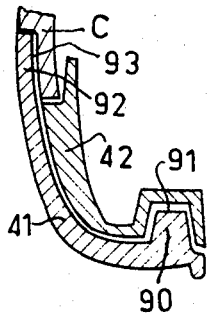
FIG. 15 is a section along the line V—V with the front half-skirt of FIG. 14 mounted on a helmet with the rear half-skirt.
Figure 16:
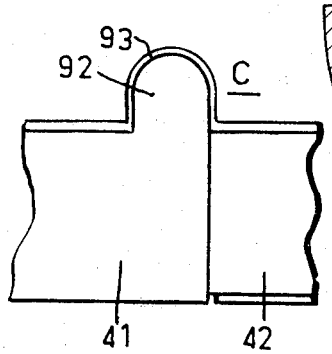
FIG. 16 is a side view of the embodiment of FIG. 15.
Figure 17:
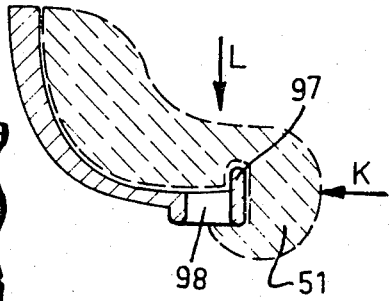
FIG. 17 is a section along the line VII—VII of FIG. 14.

The helmet and fastening device according to the invention shown in FIGS. 11 to 13 can be further improved by providing a system enabling the two half-skirts to be consolidated (FIGS. 14 to 16) and a damping system in the case of impact on the neck of the wearer on the section of the half-skirts (FIGS. 14 and 17). FIGS. 14 to 16 show a system enabling slipping of the two half-skirts on one another to be avoided and avoiding the two half-skirts from being closed in themselves. For this purpose, there is provided on the front half-skirt 41, on each side and on the inside, a circular boss 90 positioned in the zone where the heel of the rear half-skirt 42 becomes supported.

On the closing of the two half-skirts, this boss 90 becomes positioned in a corresponding recess 91 and placed on the rear half-skirt. In addition, a tongue 92, fastened to the front half-skirt 41, becomes housed in a recess 93 formed on the outer edge of the shell C and prevents the front half-skirt, urged by the rear half-skirt, from being closed in its turn by urging the locking means and the lug 48 in flexion.

Although the wearer's neck is protected, over its whole circumference, from the section of the half-skirts by a thick padding of flexible foam 51, there has been provided on the half skirts themselves a damping system for the case where the foam padding would be subjected to its maximum compression.

Referring to FIGS. 14 and 17, this shock absorbing system is constituted by perforation 98 along the inner profile of the half skirt. This perforation is limited inwardly by a rim 97 sufficiently low to avoid shearing the foam 51 and having a sufficient support surface under the effect of stress along K. To avoid sagging of this rim 97 downwards under the effect of a stress L due to the tearing off of the helmet, the rim 97 is connected to the body of the half-skirt by two ribs 95 and 96.

This device formed on the front half-skirt and the rear half-skirt (not shown) whilst holding the foam in position correctly and avoiding the emergence of the head from the helmet by its deformation, absorbs the shock of the forces along K and, for this reason, contributes to minimizing the effect of impact both on the larynx and on the cervical vertebrae.

Figure 18:
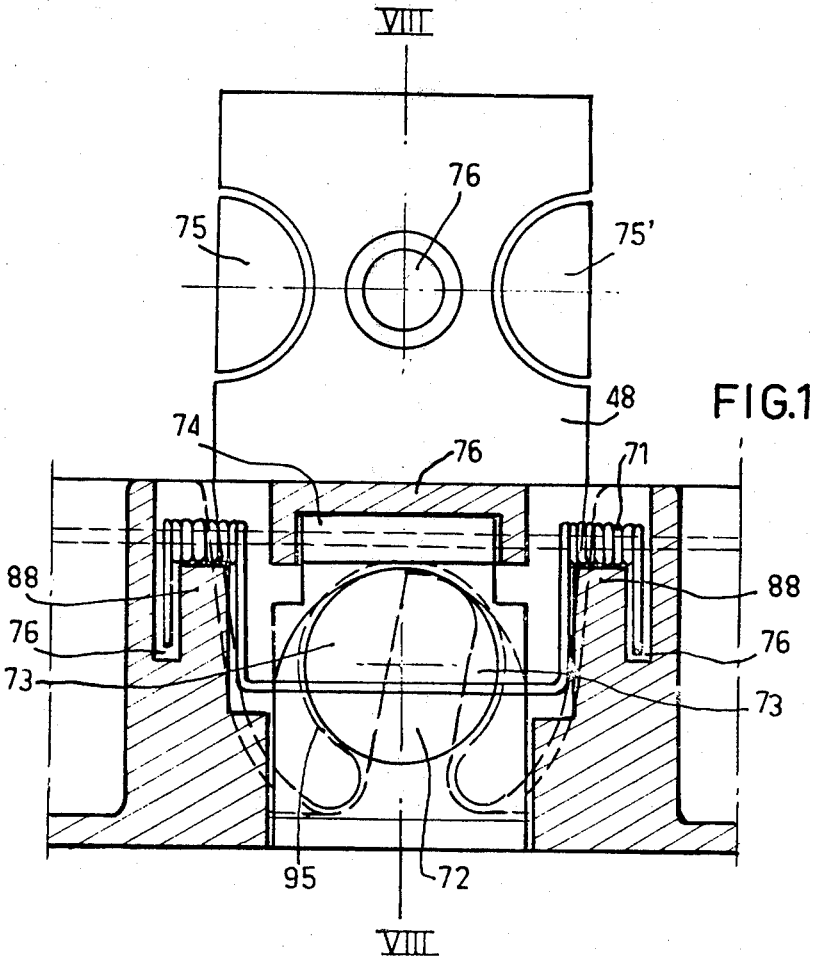
FIG. 18 is a view in elevation of one of locking means and fixing means used in the device of FIGS. 11 to 13.
Figure 19:
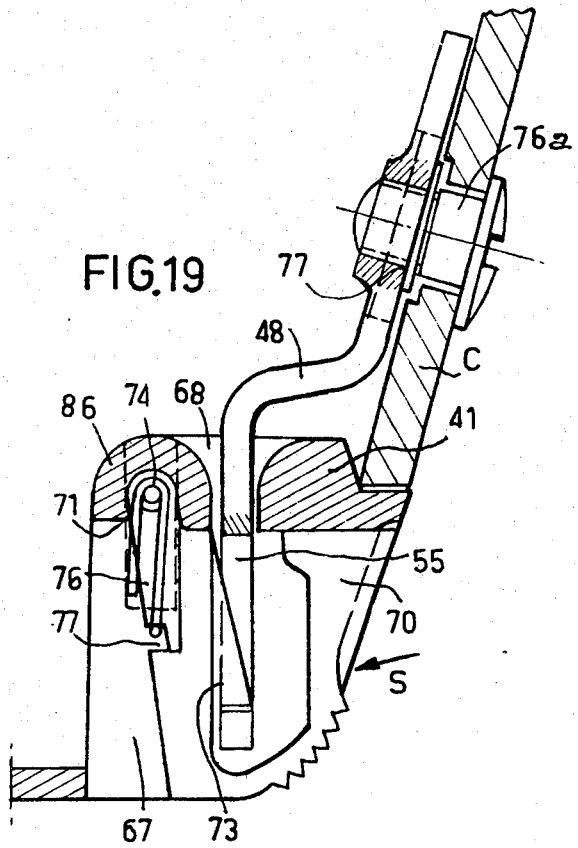
FIG. 19 is a sectional view of the locking mean and of the fixing means along the line VIII—VIII of FIG. 18.
Figure 21:
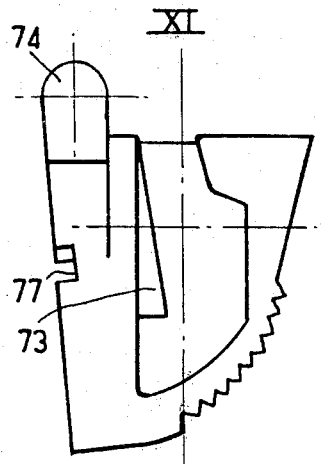
FIGS. 21 and 22 show respectively side and top view of the latch of FIG. 20.
Figure 22:
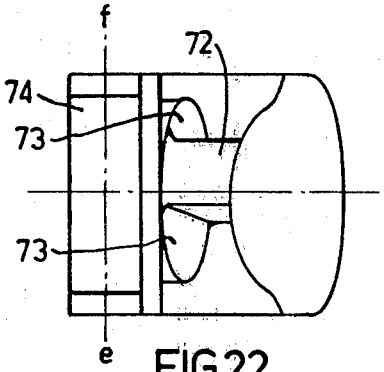
Figure 20:
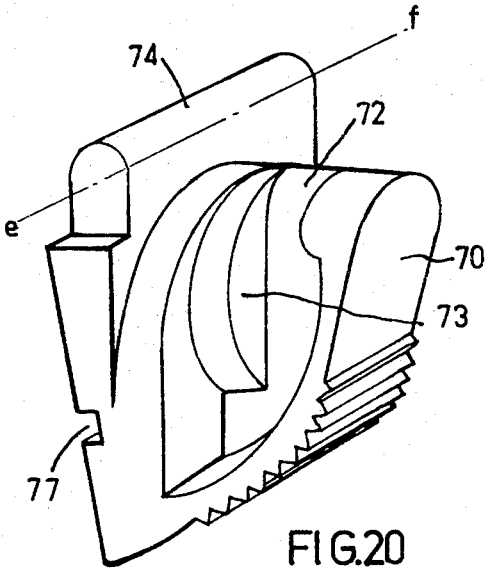
FIG. 20 is a perspective view of the latch of the locking mean show in FIGS. 18 and 19.
Figure 23:
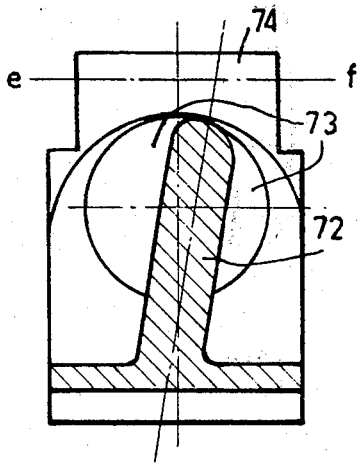
FIG. 23 is a section of the latch along the line XI—XI of FIG. 21.

The locking means 47 is shown in detail in FIGS. 18 and 19. This locking means includes a latch 70 arranged in a corresponding recess 67 provided in the half-skirt 41. This recess 67 opens at one end on the outside of the half-skirt and at the other end at the inside of the half-skirt. This recess 67 is traversed perpendicularly by a slot 68 whose upper inlet is flared, and which opens downwards. This slot is provided to enable the insertion of the fixing means 48.

The latch 70 of the locking means mates the shape of the recess 67 but has substantially the shape of an I in cross-section. This latch includes a core 72 inclined in one direction for the left locking means and in the other direction for the right locking means. On both sides of the core 72 is a beveled insertion ramp 73.

The latch 70 includes in addition a boss 74 of semi-cylindrical shape, with an axis "f" which becomes housed in the inner impression of the portion 86 forming an integral part of the half-skirt 41.

The slot 68 enables the passage of the fixing means 48 which is a tongue having a round recess 55. This recess 55 is opened downwards to slide along the core 72 of the latch and it has a diameter corresponding to that of the beveled insertion ramp 73. The tongue 48 is fixed to the shell C by two bosses 75 and 75' housed in two corresponding cut-outs of the tongue. A screw 76*a*, immobilized in translation by the clip 37, is screwed in the tongue and prevents the latter from emerging from the bosses 75 and 75'. A double torsion spring 71 becomes housed at the inner end of the recess 67, the central U shaped arm of said spring being supported on the back of the latch 70, and engaged in the notch 77 provided on said latch 70 so as to hold it in position, the two free arms being supported in the housings 76 and 76' formed for this purpose and the helicoidal parts of the spring 71 resting on shoulders 88.

On the closing of the half-skirt, the tongue 48 is inserted into the slot 68; by pressing on the ramps 73 of the latch, it forces the latter to pivot in the direction "S" around the axis "f" tightening the spring 71. When the front end of the tongue 48 is fully engaged on the latch 70, the boss of the ramp 73 is introduced into the recess 55 and causes locking.

For unlocking, one has only to press along the arrow "S" on the latch 70 to cause the latter to pivot and release the tongue 48 which can thus escape from the slot 68.

It should be noted that this locking means has great safety through the fact that it is non-unlockable without pressing along "S". In fact, the force "F" applied at "A" by the tab on the latch generates torque relative to the axis "f" acting in the direction reverse to opening and thus self-blocks said latch.

The fixing of the tongue 48 on the shell C has been designed so that, in the case of accidental blocking of the locking means, it is sufficient to unscrew the screw 76*a* by several turns to cause the tongue 48 to escape from the bosses 75 and 75' and also to be able to open the half-skirts and release the wearer. In fact, the screw 76*a* not being able to withdraw on unscrewing, forces the tongue 48 to escape from the bosses and to follow the half-skirt in its opening movement.

FIGS. 20 to 23 show the latch 70. This latch is moved in rotation along the axis "f" by means of the presence of the boss 74 which becomes housed in the inner indentation of the half-skirt. This latch comprises in addition a core 72 along which the opening of the recess of the tongue slides on the insertion of the tongue to proceed with locking. The insertion ramps 73 enable self-blocking locking to be effected.

The latch 70 includes in addition a notch 77 in which the U shaped central arm of the spring 71 becomes engaged. This spring has a double function: it enables, on the one hand the latch 70 to be held in position on the half-skirt, and on the other hand, it induces a return force enabling locking and unlocking at will.

Figure 26:
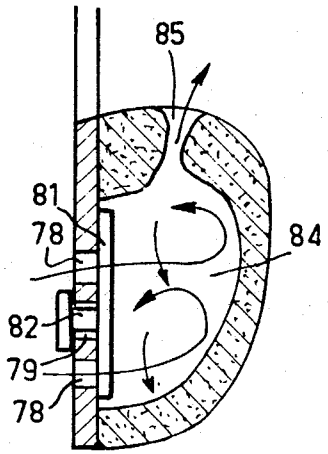
FIG. 26 is a section of the ventilation systems inked along the line XVI—XVI of FIG. 24.
Figure 24:
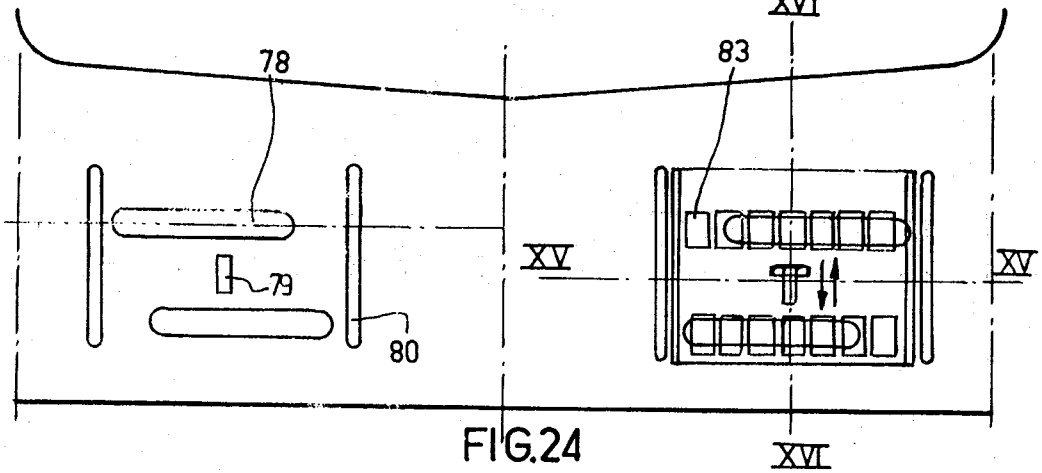
FIG. 24 is a front view of the lower front portion of the helmet including two inner ventilation systems.
Figure 25:
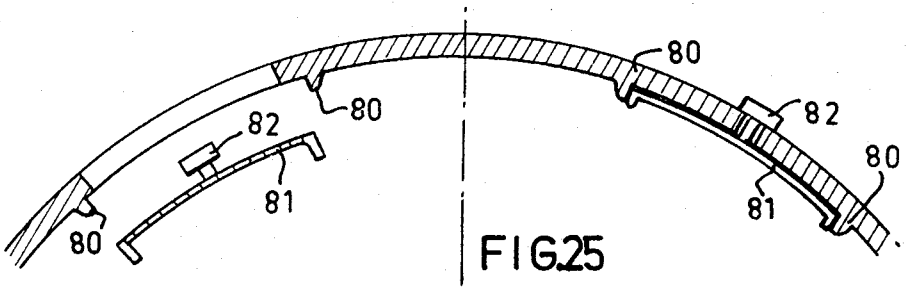
FIG. 25 is a section of the ventilation systems along the line XV—XV of FIG. 24.
Figure 27:
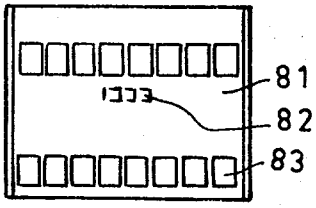
FIG. 27 shows a shutter of the ventilating systems of FIGS. 24 to 26.

FIGS. 24 to 26 show the front lower portion of the helmet, that is to say the part placed in front of the chin on which an adjustable internal ventilating system is provided. This ventilating system comprises four horizontal ports 78 positioned symmetrically in pairs with respect to the longitudinal plane of symmetry of the helmet, two small vertical slots 79 also positioned symmetrically with respect to the aforesaid plane between the horizontal ports 78 and shoulders 80 arranged on both sides of each pair of horizontal ports 78. These shoulders serve for guiding a shutter 81 (FIG. 27) which is positioned inside the shell of the helmet. Each shutter 81 is held in position by its operating knob 82 which is inserted into the vertical slots 79 by rotation of 90° around the axis of said knob.

Each shutter 81 includes two horizontal rows of square openings 83 forming a grid which is placed opposite the ports formed in the shell when the shutter 81 is in upper position (maximum ventilation) and are obstructed when the shutter is in lower position (no ventilation).

The air which, under the effect of the speed, enters the ports 78, is led through a duct 84 (FIG. 26) formed in the lining of the chin strap. The duct 84 forms, behind the shutter 81, a tranquillizing chamber where the air loses its speed and arrives in the enclosure of the helmet through an orifice 85 suitably calibrated, and oriented, which avoids jets of air on the face which could be unpleasant or damaging to the eyes in particular.

The left part of FIG. 25 shows the shutter 81 outside of the vertical slot 79 and the right hand part shows the shutter 81 in position on the shell of the helmet.

It will also be noted that there is another advantage in the helmet according to the invention. In fact, with traditional helmets including a chin strap, it frequently happens that the wearer of the helmet does not buckle his chin strap or positions it poorly below the chin, or again tightens it insufficiently: this happens frequently considering the discomfort caused by a tight chin strap. Sometimes also, the chin strap buckle becomes loose by itself. With the helmet according to the invention, such drawbacks are not to be feared. In fact, the helmet can only be worn in practice after locking the skirts. It is hence necessarily fastened in optimum manner on the head.

It should be stressed that the scope of the invention is in no way limited to the embodiments described above purely by way of illustration. The invention covers, in fact, modifications of such devices, to the extent where the latter include the fundamental arrangement of the invention, namely the extension of the base of the shell of the helmet by a rigid skirt in two parts articulated at the base and capable of being removably locked on the helmet. Thus, the design and construction of the locking means and of the cooperating means of the skirt could be considerably modified according to the requirements without however departing from the scope of the invention.

I claim:

1. Improved fastening device for securing a single piece helmet on the head, comprising essentially a rigid skirt extending completely around the base of the shell of the helmet and the lower part of a wearer's head in the region of the neck with the interposition of padding adapted to the lower part of the head, said skirt being composed of two half-skirts hinged on the helmet at opposite points of said base, and two locking means and fixing means enabling said half-skirts to cooperate with the base of the shell of the helmet.

2. Device according to claim 1, wherein the two locking means are borne by the base of the shell of the helmet and the fixing means are borne by at least one half-skirt.

3. Device according to claim 1, wherein the locking means are borne by one half-skirt and the fixing means are arranged inside the shell, said half-skirt bearing the locking means comprising a heel which becomes nested under another heel formed in the second half-skirt not housing a locking means.

4. Device according to claim 2, wherein the fixing means are borne by two half-skirts at each of their ends, said fixing means being hinged tongues shaped as circular arcs, with a stop limiting the amplitude of their pivoting, notched on their concave area and directed upwards.

5. Device according to claim 4, wherein the locking means are of the self-wedging type and each includes at the center a two-diameter sliding drop-latch held in position by a spring and accessible outside the helmet by a push-button as well as two eccentric cams, notched on their periphery, pivoting on the fixing belts of the locking means and abutting in rotation in one direction, through the action of a pre-stressed helical spring, the notches of the cams cooperating with those of the torques so as to lock the two half-skirts.

6. Device according to claim 2, wherein the fixing means are borne by one-half skirt, said half-skirt including a heel becoming nested beneath another heel formed in the second half-skirt not housing a fixing means.

7. Device according to claim 6, wherein the fixing means are hanged tongues in the form of a circular arc, with a stop limiting the amplitude of their pivoting, notched over their concave area and directed upwardly.

8. Device according to claim 6 or 7, wherein the locking means of the self-wedging type each comprise at the center a sliding drop-latch, with two diameters, held in position by a spring and accessible from outside the helmet by a push-button as well as an eccentric cam, notched on its periphery, pivoting on the fixing bolts of the locking means and abutting in rotation in one direction, by the action of a pre-stressed helical spring, the notches of each cam cooperating with those of each tongue so as to lock the half-skirt.

9. Device according to claim 6, wherein the fixing means are tongues each having a round recess.

10. Device according to claim 6, wherein the locking means each include a locking pin urged by a spring, said pin, in cross-section perpendicular to the direction of the insertion of the tongue, having approximately the shape of an I, having two wings and a core, the inner limiting surfaces of the wings being beveled, said tongue cooperating, on its insertion into the locking means with said beveled wing against the elastic force of a spring, and being locked into locking position when it is fully engaged in the opening of the locking mean.

11. Device according to claim 3, wherein the two half-skirts include, on practically the whole of the length of their line joining the shell of the helmet, a shoulder which is engaged below the shell on closing and locking.

12. Device according to claim 11, wherein there is provided on each side and inside the half-skirt bearing the locking means, a boss placed in the zone wherein the heel of the half-skirt not including a locking means becomes supported, said second half-skirt including, correspondingly, on each side, a recess, and wherein the half-skirt bearing the locking means includes in addition in the zone of each boss an outer tongue housed in a recess formed on the outer edge of the shell of the helmet.

13. Device according to claim 3, wherein the fastening means arranged inside the shell are tongues each having a round recess.

14. Device according to claim 13, wherein the locking means borne by the half-skirt are of the self-wedging type and each includes a locking latch movable in rotation and urged by a spring, said latch, in cross-section perpendicular to the direction of the insertion of the tongue, having the approximate shape of an I having two beveled insertion ramps and a core, said tongue cooperating, on its insertion in the locking mean, with said beveled ramps against the elastic force of a spring, and being blocked in locking position when it is fully-engaged in the opening of the locking means.

15. Device according to claim 11, comprising complementarily a shock-absorbing system constituted by an opening which follows the inner profile of each half-skirt, said opening being limited inwardly by a projecting edge, connected by ribs to the body of the half-skirt.

16. Device according to claim 13, comprising a safety device in the case of accidental locking of the locking means, the tongue being extractable from the bosses to permit the opening of the half-skirts, when the screw which normally holds the tongue on the bosses is manipulated.

17. Device according to claim 1, wherein the padding of the rigid skirt is constituted by a first energy-absorbing layer placed in contact itself with said skirt and a second layer formed by sealed cushions filled with a thermo-formable material enabling it to be conformed to the lower portion of the head of the wearer.

18. Device according to claim 1, wherein the hinges of the two half-skirts are diametrically opposite, assuming that the base of the helmet is approximately circular.

19. Device according to claim 1, wherein the two locking means are diametrically opposite assuming that the base of the helmet is approximately circular.

20. Device according to claim 1, wherein the locking means are arranged in the median plane of the axis formed by the hinges of the half-skirts.

21. Device according to claim 1, wherein the two half-skirts are hinged by a hinge at the base in front of the shell, another at the base at the rear of the shell.

22. Device according to claim 1, wherein the two half-skirts are hinged by a hinge, one on the left lateral base of the shell, the other on the right lateral base of the shell.

23. Device according to claim 1, wherein the position of the hinges of the two half-skirts on the helmet is adjustable in height by moving the hinges.

24. Device according to claim 1, wherein the one or more half-skirts arranged under the front of the shell of the helmet include a ventilating duct taking in external air through openings ensuring the aeration of the inside of the helmet.

25. Device according to claim 1, wherein the front lower part of the helmet includes at least one ventilating system comprising at least one horizontal port and one vertical slot arranged on the shell of the helmet and two shoulders arranged on each side of the horizontal port within the shell of the helmet, so as to permit the guiding of a shutter with at least one row of apertures, said shutter sliding along the vertical slot.

26. Device according to claim 25, including two ventilating systems arranged symmetrically with respect to the longitudinal plane of symmetry of the helmet, each system comprising two horizontal ports and a shutter with two aperture rows.

27. A protective helmet notably for a driver or passengers of a vehicle including a single piece rigid protective shell completely surrounding a wearer's head above the neck and a fastening skirt extending around the base of the shell for surrounding the lower part of the wearer's head in the region of the neck, said skirt being likewise rigid and removably fixed to the shell and a padding conformed to the lower part of the head being disposed inside the skirt.

28. A protective helmet according to claim 27 wherein the rigid skirt is composed with several pieces at least one of which is movable, said helmet comprising locking means and fixing means ensuring the locking of the movable parts of the skirt relative to the shell.

29. A protective helmet according to claim 28 wherein the skirt is substantially composed of two movable half-skirts hinged on the shell.

30. A protective helmet according to claim 29, wherein the locking means are borne by one half-skirt and the fixing means are arranged inside the shell, said half-skirt bearing the locking means comprising a heel which becomes nested under another heel formed in the second half-skirt not having a locking mean.

31. A protective helmet according to claim 29, wherein the locking means are borne by the base of the shell of the helmet and the fixing means are borne by at least one half-skirt, said fixing means being hinged tongues shaped as circular arcs, with a stop limiting the amplitude of their pivoting, notched on their concave area and directed upwards.

32. A protective helmet according to claim 31, wherein the fixing means are borne by one half-skirt, said half-skirt comprising a heel becoming nested beneath another heel formed in the second half-skirt not having fixing means.

33. A protective helmet according to claim 32, wherein the locking means are of the self-wedging type and each includes at the center a two-diameter sliding drop latch held in position by a spring and accessible outside the helmet by a push-button as well as two excentric cams, notched on their periphery, pivoting on the fixing bolts of the locking means and abutting in rotation in one direction, through the action of a prestressed helical spring, the notches of the cams cooperating with those of the tongues so as to lock the two half-skirts.

34. A protective helmet according to claim 31, wherein the locking means each include a locking pin urged by a spring, said pin, in cross-section perpendicular to the direction of the insertion of the tongue, having approximately the shape of an I, having two wings and a core, the inner limiting surfaces of the wings being beveled, said tongue cooperating, on its insertion into the locking means, with said beveled wing against the elastic force of a spring, and being locked into locking position when it is fully engaged in the opening of the locking means.

35. A protective helmet according to claim 30, wherein the two half-skirts include, on practically the whole of the length of their line joining the shell of the helmet, a shoulder which is engaged below the shell on closing and locking.

36. A protective helmet according to claim 35, wherein there is provided, on each side and inside the half-skirt bearing the locking means, a boss placed in the zone wherein the heel of the half-skirt not including a locking means becomes supported, said second half-skirt including, correspondingly, on each side, a recess, and wherein the half-skirt bearing the locking means includes in addition in the zone of each boss an outer tongue housed in a recess formed on the outer edge of the shell of the helmet.

37. A protective helmet according to claim 30, wherein the fixing means arranged inside the shell are tongues each having a round recess.

38. A protective helmet according to claim 37, wherein the locking means borne by the half-skirt are of the self-wedging type and each includes a locking latch movable in rotation and urged by a spring, said latch, in cross-section perpendicular to the direction of the insertion of the tongue, having the approximate shape of an I having two beveled insertion ramps and a core, said tongue cooperating on its insertion in the locking means, with said beveled ramps against the elastic force of a spring, and being blocked in locking position when it is fully engaged in the opening of the locking means.

39. A protective helmet according to claim 35, comprising complementarily a shock-absorbing system constituted by an opening which follows the inner profile of each half-skirt, said opening being limited inwardly by a projecting edge, connected by ribs to the body of the half-skirt.

40. A protective helmet according to claim 36, comprising a safety device in the case of accidental locking of the locking means, the tongue being extractable from the bosses to permit the opening of the half-skirts when the screw which normally holds the tongue on the bosses is manipulated.

41. A protective helmet according to claim 27, wherein the padding of the rigid skirt is constituted by a first energy-absorbing layer placed in contact itself with said skirt and a second layer formed by sealed cushions filled with a thermo-formable material enabling it to be conformed to the lower portion of the head of the wearer.

42. A protective helmet according to claim 31 wherein the hinges of the two half-skirts are diametrically opposite, assuming that the base of the helmet is approximately circular.

43. A protective helmet according to claim 42 wherein the two locking means are diametrically opposite assuming that the base of the helmet is approximately circular.

44. A protective helmet according to claim 43 wherein the locking means are arranged in the median plane of the axis formed by the hinges of the half-skirts.

45. A protective helmet according to claim 31 wherin the two half-skirts are hinged by a hinge at the base in front of the shell, another at the base at the rear of the shell.

46. A protective helmet according to claim 31, wherein the two half-skirts are hinged by a hinge, one on the left lateral base of the shell, the other on the right lateral base of the shell.

47. A protective helmet according to claim 31 wherein the position of the hinges of the two half-skirts on the helmet is adjustable in height by moving the hinges.

48. A protective helmet according to claim 27, wherein the one or more half-skirts arranged under the front of the shell of the helmet include a ventilating duct taking in external air through openings ensuring the aeration of the inside of the helmet.

49. A protective helmet according to claim 27 wherein the front lower part of the helmet includes at least one ventilating system comprising at least one horizontal port and one vertical slot arranged on the shell of the helmet and two shoulders arranged on each side of the horizontal port within the shell of the helmet, so as to permit the guiding of a shutter with at least one row of apertures, said shutter sliding along the vertical slot.

50. A protective helmet according to claim 49 including two ventilating systems arranged symmetrically with respect to the longitudinal plane of symmetry of the helmet, each system comprising two horizontal ports and a shutter with two aperture rows.

* * * * *